US012686999B2

(12) United States Patent
Denzler et al.

(10) Patent No.: US 12,686,999 B2
(45) Date of Patent: Jul. 21, 2026

(54) FLUIDIC ASSEMBLY, CORRESPONDING USE, AND FITTING

(71) Applicant: Neoperl GmbH, Müllheim (DE)

(72) Inventors: Oliver Denzler, Bottmingen (CH); Fabian Wildfang, Müllheim (DE); Holger Schürle, Müllheim (DE); Marc Tempel, Freiburg (DE); Claudio Cupelli, Freiburg (DE)

(73) Assignee: Neoperl GmbH, Müllheim (DE)

( * ) Notice: Subject to any disclaimer, the term of this patent is extended or adjusted under 35 U.S.C. 154(b) by 0 days.

(21) Appl. No.: 18/830,850

(22) Filed: Sep. 11, 2024

(65) Prior Publication Data

US 2025/0084624 A1 Mar. 13, 2025

(30) Foreign Application Priority Data

Sep. 13, 2023 (DE) ..... 102023124775.1

(51) Int. Cl.
*E03C 1/04* (2006.01)
*E03C 1/02* (2006.01)

(52) U.S. Cl.
CPC ..... *E03C 1/0404* (2013.01); *E03C 1/021* (2013.01); *Y10T 137/9464* (2015.04)

(58) Field of Classification Search
CPC ... E03C 1/084; E03C 1/0404; Y10T 137/9464
USPC ..... 137/801
See application file for complete search history.

(56) References Cited

U.S. PATENT DOCUMENTS 5,549,273 A * 8/1996 Aharon ..... E03C 1/057 251/30.05
5,758,690 A * 6/1998 Humpert ..... E03C 1/0404 4/678
8,006,922 B2 * 8/2011 Katzer ..... E03C 1/08 285/146.1
8,061,386 B2 * 11/2011 Mueller ..... F16L 27/082 285/281
D650,051 S * 12/2011 Schurle ..... D23/269
8,070,076 B2 * 12/2011 Erickson ..... E03C 1/0404 239/587.5
8,430,345 B2 * 4/2013 Esche ..... E03C 1/0404 239/587.5
8,528,579 B2 * 9/2013 Jonte ..... E03C 1/05 137/552

(Continued)

FOREIGN PATENT DOCUMENTS

DE 3637470 A1 5/1988
DE 10234740 A1 2/2004

(Continued)

*Primary Examiner* — Daphne M Barry
(74) *Attorney, Agent, or Firm* — Volpe Koenig

(57) ABSTRACT

A sanitary fitting (1) having a fitting housing (2) in which a valve (5) is disposed, an outflow pipe (11) in which an outflow piece (13) is disposed and which is connected to the fitting housing (2), and an outflow hose (15) which fluidically connects the outflow piece (13) to the valve (5). The outflow pipe (11) is designed to be pivotable relative to the fitting housing (2); the outflow hose (15) has, at a location spaced apart from both its ends, a fixed deflection (16); and the fitting housing (2) has a duct (17) in which the outflow hose (15) is routed and in which the outflow hose (15) is rotatable about an axis running along a pivot axis of the outflow pipe (11).

23 Claims, 5 Drawing Sheets

(56) References Cited

U.S. PATENT DOCUMENTS

| | | | | |
|---|---|---|---|---|
| 8,733,386 | B2 * | 5/2014 | Sun | E03C 1/102<br>137/216 |
| 8,757,206 | B2 * | 6/2014 | Carignan | F16K 21/04<br>251/106 |
| 9,085,879 | B2 * | 7/2015 | Mielke | E03C 1/055 |
| 9,243,391 | B2 * | 1/2016 | Jonte | E03C 1/05 |
| 9,534,362 | B2 * | 1/2017 | Städtler | E03C 1/086 |
| 9,556,598 | B2 * | 1/2017 | Stadtler | E03C 1/084 |
| 9,637,892 | B2 * | 5/2017 | Lee | E03C 1/0403 |
| 9,714,501 | B2 * | 7/2017 | Keiter | E03C 1/055 |
| 9,840,831 | B1 * | 12/2017 | Esche | E03C 1/0404 |
| 9,995,025 | B2 * | 6/2018 | Wang | A47K 5/1217 |
| 12,270,481 | B2 * | 4/2025 | Hung | E03C 1/0404 |
| 2008/0178935 | A1 | 7/2008 | Thomas | |

FOREIGN PATENT DOCUMENTS

| | | | |
|---|---|---|---|
| DE | 202022101669 | U1 | 6/2022 |
| EP | 2511435 | B1 | 8/2018 |
| EP | 3228764 | B1 | 2/2020 |
| WO | 2015160870 | A1 | 10/2015 |

* cited by examiner

FLUIDIC ASSEMBLY, CORRESPONDING USE, AND FITTING

CROSS-REFERENCE TO RELATED APPLICATIONS

This application claims priority to German Patent Application No. 10 2023 124 775.1, filed Sep. 13, 2023, which is incorporated herein by reference as if fully set forth.

TECHNICAL FIELD

The invention relates to a fluidic assembly having a valve, an outflow piece which is connectable at an outflow pipe of a fitting, and a hose which fluidically connects the outflow piece to the valve.

The invention furthermore relates to a fitting having a fitting housing in which a valve is disposed, an outflow pipe in which an outflow piece is disposed and which is connected to the fitting housing, and a hose which fluidically connects the outflow piece to the valve.

BACKGROUND

In general, a fitting can be characterized, for example, as a casing for a fluidic path for the purpose of dispensing the fluid, typically having a valve for controlling a flow of fluid. Two different types are known in principle. On the one hand, such fittings in which the fitting housing comes into contact with the fluid and, on the other hand, such fittings in which the fitting housing receives a fluidic assembly that per se is in contact with the fluid, thus avoiding contact between the fluid and the fitting housing.

Such fittings are known, for example in the form of kitchen fittings which have a pivotable outflow. Such fittings nowadays have the disadvantage that fluidic sealing at the pivoting location is very complex. Furthermore, the shaping is highly restricted due to the valve being disposed within the fitting body. Furthermore, the outlet element which guides the jet has to be sealed in relation to the fitting, which is technically easy to implement only in the case of circular jet shapes. This also leads to a heavily restricted design of such fittings. Fittings in which the fitting housing is implemented as part of an item of furniture, for example as a shelf board or wall cladding, are also known.

As an example of a fitting, a sanitary fitting can be characterized in that, for example, it forms at least one outflow pipe, the alignment of which is able to be predefined by assembling the sanitary fitting at or on a substrate.

SUMMARY

This invention is based on the object of improving such fittings.

This object is achieved by a fluidic assembly, the use thereof, and a fitting each having one or more of the features disclosed herein.

In one embodiment of a fluidic assembly of the aforementioned type, the outflow piece has a non-circular circumferential contour. Since the outflow piece is inserted in an outflow piece connector, in particular outflow piece receptacle, preferably embodied from plastics material and is fluidically sealed in relation to the latter, the requirement of sealing the outflow piece directly in relation to the fitting outflow is dispensed with in accordance with this embodiment. This simplifies sealing due to the largely unrestricted shape of the outflow piece connector which is preferably embodied in plastics material and optionally is releasably connected to the fitting outflow. As a result, the shape of the outflow piece and the shape of the fitting are largely not linked to one another.

The outflow piece can be releasably connected to the outflow piece connector which is formed on the outflow hose, for example. This allows the outflow piece, for example as a jet regulator, to be easily replaced. The outflow piece connector herein can be captively formed on the outflow hose, for example connected thereto in a materially integral manner or fastened thereto in an extraction-proof manner. Claws which interlock with the outflow hose and are held in a self-securing manner on the outflow piece connector by way of a holding-down device have been proposed for the extraction-proof fastening, for example. Embodiments in which the holding-down device is able to be moved to a releasing position in order to loosen the claws and release the outflow hose are also known and may also be used.

In general, the outflow piece can be specified to achieve a desired jet quality of an exiting water jet. For example, the outflow piece can have a splitter stage which can split an incoming water flow into many individual jets, for example, and/or have a mixer stage which can make it possible to mix air into the water jet, for example. A typical example of an outflow piece is a (preferably aerated or non-aerated) jet regulator; a further example is a jet former. The outflow piece can also have at least one valve function, for example as a diverter or as a shut-off valve.

In this way it is possible to achieve fittings with unusual shapes, or to integrate an outflow piece into an item of furniture entirely without a fitting, whereby alternative designs are possible by virtue of the non-circular shape.

Therefore, sealing the outflow piece in relation to the outflow pipe is not necessary in the case of the invention, so that the outflow piece can assume arbitrary shapes. In particular, the outflow piece can be of an oval or substantially angular shape, even with radiused corners.

The outflow piece connector can serve to attach the outflow piece to an outflow hose in a fluidically tight manner. Wetting of the sanitary fitting can thus be avoided; a sanitary fitting can even be entirely dispensed with, for example by disposing the fluidic assembly on an item of furniture.

For example, the outflow piece connector can be designed as an outflow piece receptacle into which the outflow piece is able to be inserted, in particular screwed and/or snap-fitted, in a fluidically tight manner.

In general, the outflow piece can be captively disposed on the outflow piece connector, for example in the outflow piece receptacle already mentioned. This can take place by way of connecting means, for example, which prevent or impede a self-acting release.

In a further embodiment, the outflow pipe is alternatively or additionally designed to be pivotable relative to the fitting housing.

This is enabled by the use according to the invention of the fluidic assembly described. It is advantageous here that the fitting housing does not have to be sealed on the pivotable outflow pipe because fluidic contact with the fitting housing is avoidable. This seal often causes issues in terms of durability.

The outflow hose is preferably not sheathed because no tensile stress arises in use, and because the outflow hose is not longitudinally displaced in use, with the result that abrasion does not occur either. Alternatively or additionally, the outflow hose can be extruded and/or designed to be single-layered.

It is particularly advantageous when a fitting, in particular sanitary fitting, of the type described at the outset is formed in which the fluidic assembly is installed in such a way that the outflow hose is routed in an outflow pipe. If the outflow pipe is pivotable, the outflow hose can provide the necessary flexibility in order not to impede this pivoting movement.

The outflow hose can have, at a location spaced apart from both its ends, a fixed deflection which is optionally releasable, and in one embodiment is embodied in a U-shape or a V-shape. Furthermore, the fitting housing can have a duct in which a portion of the outflow hose is routed and in which the portion of the outflow hose is rotatable about an axis that runs along a pivot axis of the outflow pipe, in particular parallel to the pivot axis. Pivoting of the outflow pipe is made possible in this way, wherein the hose is twisted within the duct. This rotatability is guaranteed by the duct because the hose does not have to be constricted or clamped by other structural elements within the duct.

Alternatively or additionally, it can be provided here that the outflow hose is fastened in the deflection and/or in the outflow piece connector so as to be rotatable about its longitudinal axis. A compensation of torsional stresses is thus easily achievable. Alternatively or additionally, it can also be provided that a mixed water hose which is connected to the deflection and is described in more detail hereunder is rotatably connected to the deflection and/or the valve. This also enables a compensation of torsional stresses in the outflow hose.

The rotatability can in each case by achieved, for example, by a holding-down device which is rotatable relative to a claw support, and/or by a claw support which is rotatable on the received (for example outflow or mixed water) hose.

Above all in combination with the abovementioned embodiment it is not necessary to seal the outflow pipe in relation to the fitting housing of the fitting, so that a fitting is able to be produced more easily and more cost-effectively, and furthermore fewer components are required than in the prior art.

In a further embodiment, the outflow piece is alternatively or additionally fluidically connected to the valve. The valve is disposed below a base point of the sanitary fitting, in particular outside the fitting housing, and there is a control connection to the valve. The fitting housing furthermore has a duct in which the hose is routed between the valve and the outflow element, and/or the control connection is routed. In this way, a valve is disposable so as to be remote from its activation. In this way, the fitting can be of a very compact construction and is also freer in terms of its shape because there does not have to be any space for the valve or a valve cartridge. The valve is triggered by way of the control connection.

The control connection herein can act, for example, mechanically and/or fluidically (hydraulically, pneumatically).

The valve herein can be a conventional valve or else, for example, a diaphragm valve which is able to be triggered by way of a pilot valve. In this instance, the control connection can expediently be to the pilot valve, or establish an operative connection between the pilot valve and the valve.

As opposed to a kitchen fitting mentioned above, it is provided according to the invention that the hose is connected directly to the outflow piece and connects the latter directly to the valve. While the extendible spout is connected to the hose in the known kitchen fittings and the entire spout thus directs water. This is possible because the water routing from the valve to the outflow piece takes place through the hose, the outflow pipe per se thus not requiring any water routing.

The control connection is preferably designed as a rod, flexible tube, Bowden cable or toggle link. Other embodiments can also comprise an electrically activated pilot valve so that the control connection could also consist of electrical lines. Furthermore, the control connection could also comprise a hydraulic or pneumatic connection between the pilot valve and the main valve.

In one embodiment, the sanitary fitting has a fastening element by way of which the valve is fastened to the fitting housing and/or to a fitting support. Easy assembling of the valve is made possible in this way.

A fitting support can be characterized, for example, as a substrate on which a sanitary fitting is able to be fixedly assembled for use. For example, a fitting support can be designed as a vanity or as a shelf.

In one embodiment, the outflow piece has a polygonal and/or concave circumferential contour.

The circumferential contour can also be composed of sections of straight and curved lines. For example, in this way a contour of a rectangle with two semicircular disks on mutually opposite sides can be formed, the diameter of said semicircular disks being equal to a length of the sides.

In one embodiment, the outflow piece is inserted in an outflow piece receptacle fastened to the fitting housing. The advantage herein is that the outflow piece receptacle does not have to be sealed in relation to a fitting housing.

In one embodiment, the outflow piece receptacle has an external contour that is adapted to its internal contour. This means that the external contour is of a substantially identical shape as the internal contour.

In one embodiment, the outflow piece is fastened by a snap-fit latching connection. It is possible in this way for the outflow piece to be locked in position without being screwed in. In particular, an outflow piece can be fastened or assembled without a tool.

In one embodiment, a seal is disposed between the outflow piece and the outflow piece receptacle.

In one embodiment, the duct extends at least between the fixed deflection and the water outflow and/or between the fixed deflection and the valve. In this way, the hose is able to be designed with at least one change of direction in a fluidic path from the valve to the outflow piece.

A fixed deflection herein can be characterized, for example, as a deflection at a fixed position within the hose. In this sense, a fixed deflection does not move conjointly with a change in the bend or the shape of the hose.

In one embodiment, the duct extends separately from an infeed hose and an outflow hose of the valve. Friction between the hoses can be prevented in this way. This friction can either lead to damage to the hoses or to an impediment of a pivoting movement.

In one embodiment, the hose is rotatably fastened in the deflection and/or the valve. Compensating torsion on a twisted hose is possible in this way. A stability of the fluidic assembly is thus able to be increased.

In one embodiment, the lateral internal dimension of the duct is at least double the hose diameter. In this way, both the upward and downward portion of the hose, thus leading to and from the deflection, can be movably received in the duct. The hose is able to yield laterally.

In one embodiment, the fitting housing is designed without a seal on at least one pivoting location of the outflow pipe. The operational reliability and the stability are increased as a result. This is because a seal is always subjected to wear, with the result that a fitting will inevitably begin to leak at this sealing location over time. This is circumvented by the advantageous design embodiment because no seal is required and provided. A greater degree of freedom in the choice of shape and material is also provided in this way.

In one embodiment, the mixed water hose is fluidically connected at a location of the valve that in the use position of the valve faces away from the outflow piece. In this way, lateral leakages on the valve are able to be avoided. This can be advantageous in terms of a fitting design because less lateral installation space is required.

In one embodiment, the outflow hose, between the outflow piece and the valve-proximal end thereof, extends in a portion outside the fitting housing, in particular wherein the deflection is disposed outside the fitting housing. Easy assembling of the hoses and the deflection is made possible in this way.

In one embodiment, the outflow hose is fluidically connected to the mixed water hose by way of a connecting element that forms the deflection.

In one embodiment, the deflection establishes a fluidic change of direction, in particular a reversal of direction, between the mixed water hose and the outflow hose.

The invention furthermore comprises a fluidic assembly having a hose, an outflow piece, an outflow piece receptacle and a valve for forming a sanitary fitting having one or more of the features disclosed herein.

BRIEF DESCRIPTION OF THE DRAWINGS

The invention is explained in more detail hereunder by means of exemplary embodiments with reference to the appended drawings.

In the drawings.

DETAILED DESCRIPTION

Figure 1:
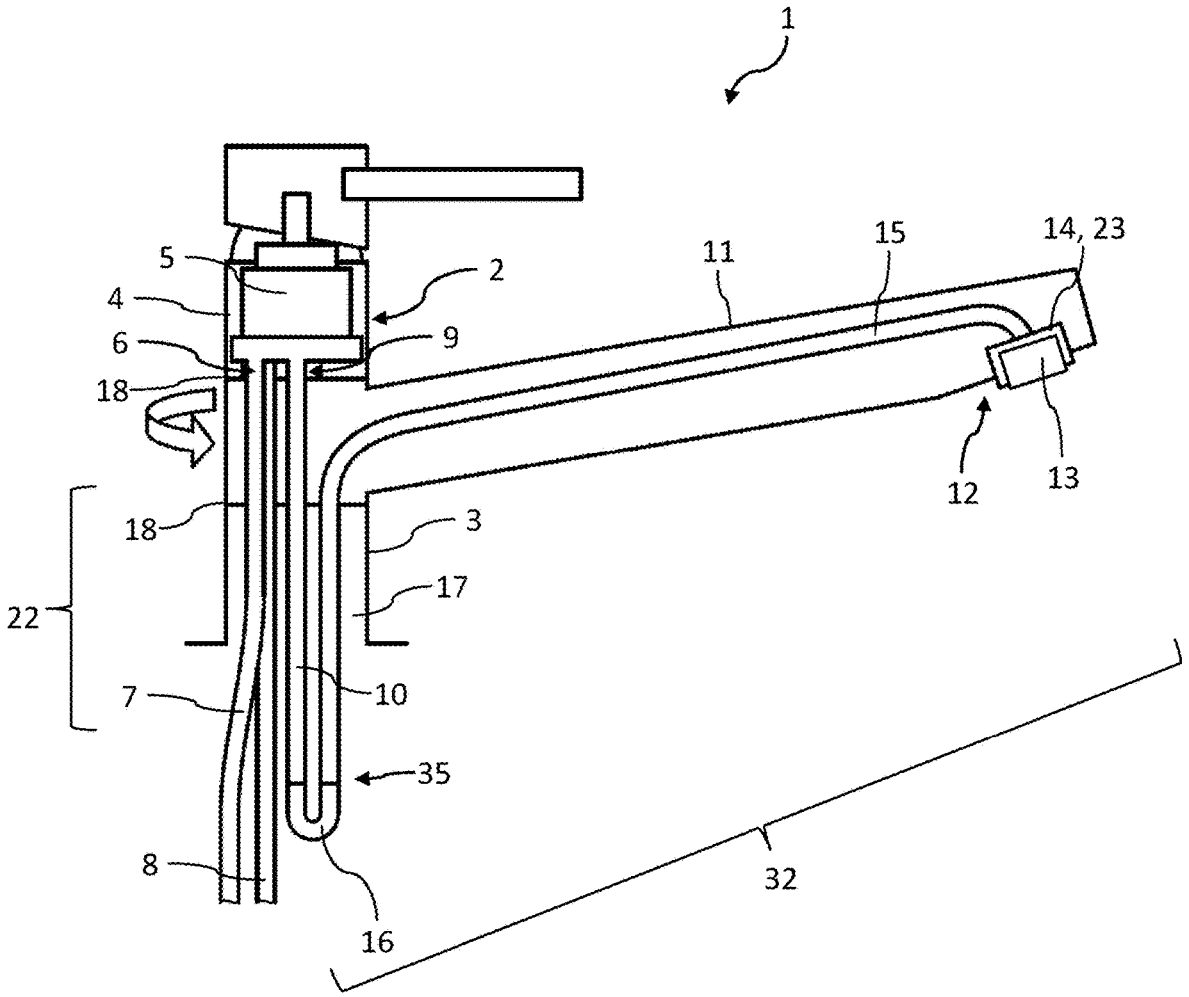
FIG. 1 shows a sanitary fitting having a pivotable outflow pipe which is disposed between a fastening and a valve on the fitting housing.

FIG. 1 shows a sanitary fitting 1 as an example of a fitting according to the invention, having a fitting housing 2. The fitting housing 2 in the example has a lower housing part 3 which is designed, for example, for fastening to a vanity or a kitchen worktop, and an upper housing part 4. A valve 5, for example in the form of a self-contained valve cartridge, is disposed in the upper housing part.

The valve 5 has two infeed connectors 6 in which a cold water hose 7 and a hot water hose 8 are connected in the example. The connection of the hoses 7, 8 to the valve 5 can be performed, for example, by way of a plug connection in which the hose is plugged directly into a plug connection receptacle. In particular, no hose stem or similar connecting element is required herein.

The valve 5 moreover has an outflow connector 9 which, in a manner analogous to the infeed connectors 6, is designed as a direct plug connection receptacle into which a mixed water hose 10 is able to be plugged.

This plug connection on the outflow connector 9 is preferably designed to be co-rotational in such a way that the mixed water hose 10 cannot rotate about its axis within the plug connection receptacle.

Independently thereof, the plugged connections of the infeed connectors 6 can also be designed to be co-rotational.

The sanitary fitting 1 furthermore has an outflow pipe 11 which in this embodiment is disposed between the lower housing part 3 and the upper housing part 4 so as to be pivotable on the fitting housing 2, whereby the pivot axis runs approximately vertically through the center of the fitting housing 2. The outflow pipe 11 runs approximately radially in relation to the fitting housing 2, wherein the outflow pipe is inclined upward in relation to a horizontal.

An outflow piece 13 is disposed on the free end 12 of the outflow pipe 11.

In a manner known per se, the outflow piece 13 can have, in the interior, a splitter stage and a mixer stage, optionally a flow restriction and/or flow reduction stage. For example, the outflow piece 13 can be a jet regulator.

According to one embodiment of the invention, the outflow piece 13 has a non-circular circumferential contour. An outflow piece connector 23, presently an outflow piece receptacle 14, to which the outflow piece 13 is connected, or in which the outflow piece 13 is inserted, is disposed in the outflow pipe 11.

The internal contour of the outflow piece receptacle 14 is preferably adapted to the external contour of the outflow piece 13, so is thus designed in such a way that the outflow piece 13 is able to be seamlessly inserted so as to fit into the outflow piece receptacle 14.

Independently thereof, the external contour of the outflow piece receptacle 14 can be adapted to its internal contour.

An outflow hose 15 which is fluidically connected to the outflow piece 13 is disposed inside the outflow pipe 11. A co-rotational plug connection is preferably also used here. The outflow hose 15 here can be fastened directly, thus without intermediary parts, to the outflow piece 13. Alternatively, the outflow hose can also be connected to the outflow piece receptacle 14, as is shown in the example.

If the outflow piece 13 is fluidically connected by way of the outflow hose 15, sealing of the outflow piece 13 in relation to the outflow piece receptacle 14 and/or the outflow pipe 11 is not necessary. If the outflow hose 15 is connected to the outflow piece connector 23, for example the outflow piece receptacle 14, it is advantageous for a seal to be disposed between the outflow piece 13 and the outflow piece connector 23, in particular the outflow piece receptacle 14.

The outflow piece 13 can preferably be fastened without a tool in the outflow piece receptacle 14 by way of a latching or snap-fit connection, so as to be removable.

The outflow hose 15 and the mixed water hose 13 are fluidically connected to one another by way of a deflection 16. The deflection 16 herein is designed to be approximately U-shaped and has two plug connection receptacles into which the outflow hose 15 and the mixed water hose 13 are able to be plugged, respectively. It is advantageous here when the plugged connections are also designed to be co-rotational.

It is particularly advantageous when the mixed water hose 13 above all is sized to be so long that the deflection 16 lies outside the fitting housing 2. In this way, the deflection 16 can be easily assembled at an intended site after the sanitary fitting 1 has been assembled. For this purpose, the valve-proximal end 35 of the outflow hose 15 extends into a region outside the fitting housing 2.

The valve 5, the outflow hose 15, the mixed water hose 13, the deflection 16, the outflow piece 13 and the outflow piece connector 23 form a fluidic assembly 32. The fluidic assembly 32 can be operated without a fitting housing 2 and without an outflow pipe 11.

According to one embodiment of the invention, the fitting housing 2 has a duct 17 in which at least the mixed water hose 13, preferably also the outflow hose 15, is/are routed. The cross section of the duct 17 here is preferably sized in such a way that it is larger than double the cross section of the hoses routed therein. In this instance, the two hoses 13 and 15 are freely routed within the duct and in particular do not have any kinks or physical contact, for example with the cold water hose 7 and/or the hot water hose 8. Free pivotability of the outflow pipe 11 is made possible as a result. This is because the outflow hose 15 is inevitably also rotated within the duct when the outflow pipe 11 is pivoted. This rotation is transmitted to the mixed water hose 13 by way of the deflection 16.

The co-rotational plug connection, or generally a co-rotational connection of the hoses 13 and 15 to the deflection 16 and to the valve 5, is above all significant here. This is because the co-rotational connection is able to be more easily designed to be permanently tight than a rotational connection. The torsional forces arising in the hoses due to the pivoting of the outflow pipe 11 can be easily absorbed by the co-rotational connection, so that only the mixed water hose 10 and/or the outflow hose 15 are/is twisted.

It can be advantageous here when the mixed water hose 13 and/or the outflow hose 15 are/is received with play within the duct 17. In this way, assembly can be simplified, for instance.

The duct 17 can also be designed to be structurally separate within the fitting housing 2.

A further advantage of this assembly lies in the fact that the outflow pipe 11, on its pivoting locations 18, does not have any seal in relation to the fitting housing 2. This is because the outflow pipe 11 overall does not direct any water. As a result, the pivoting location 18 is able to be embodied in a simpler and more durable manner, on the one hand. And no wear is created on a seal at these pivoting locations 18.

Figure 2:
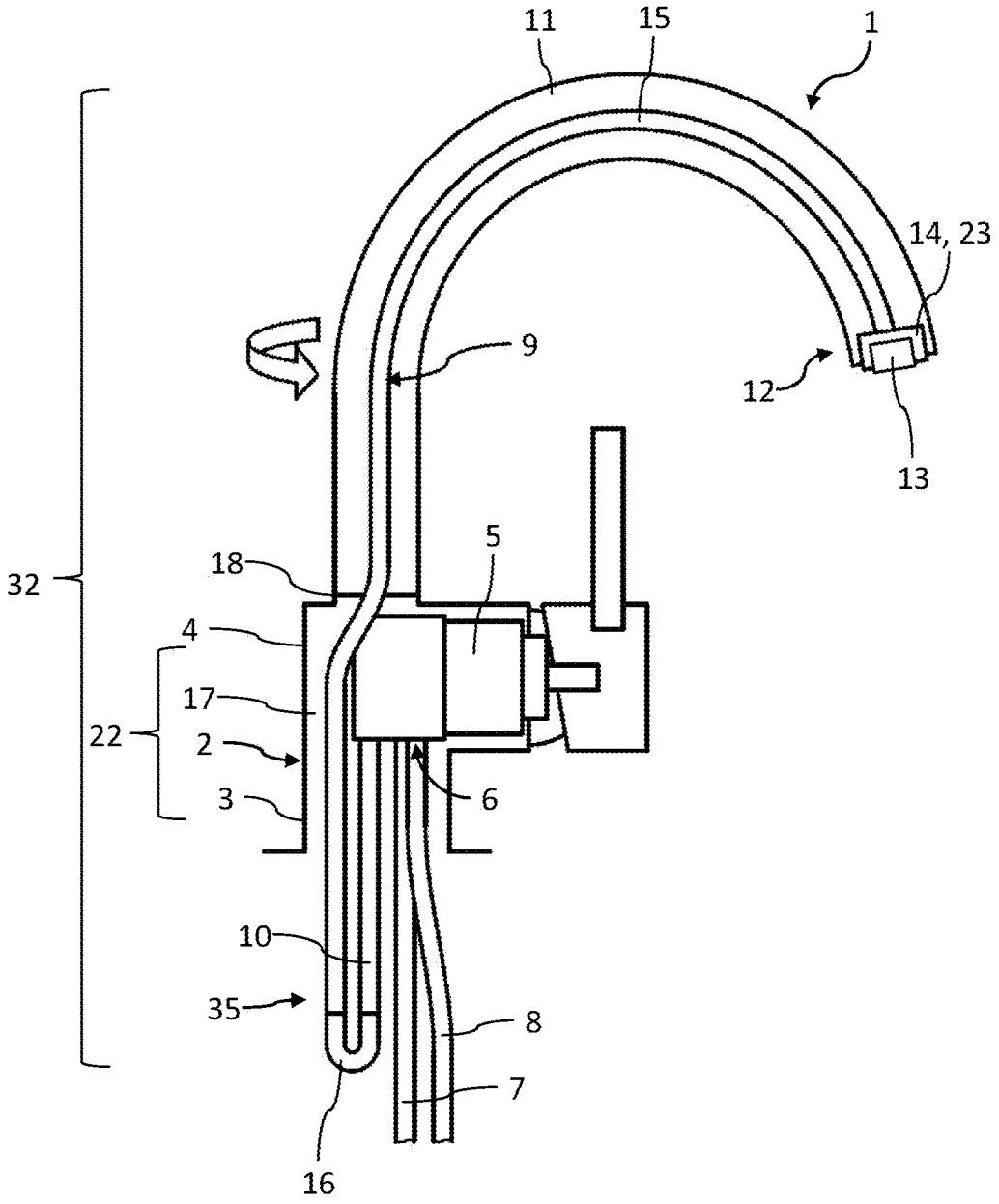
FIG. 2 shows a sanitary fitting having a pivotable outflow pipe which is integrally disposed on a fitting housing having a valve.

FIG. 2 shows a further embodiment of a sanitary fitting 1 having a somewhat different construction than the sanitary fitting 1 of FIG. 1. Nevertheless, identical or functionally equivalent features are provided with the same reference signs. Only the features which differ in comparison to FIG. 1 are explained in more detail hereunder.

The fitting housing 2 in this example has an outflow pipe 11 which is disposed approximately in an extension of the central axis of the fitting housing 2, vertically upward, on the upper housing part 4. The outflow pipe 11 here is designed so as to be approximately U-shaped. Accordingly, in this embodiment there is only one pivoting location 18 between the fitting housing 2 and the outflow pipe 11.

The valve 5 in this embodiment is disposed laterally on the fitting housing 2, whereby a valve cartridge is also used here.

The outflow hose 15 here runs past the valve 5 within the duct 17. The duct 17 is sized in such a way in particular at this location that the outflow hose 15 is neither clamped nor impeded in any other way in terms of its movement. As a result, the outflow hose 15 or the sanitary fitting 1 overall is prevented from being damaged by pivoting of the outflow pipe 11.

Figure 3:
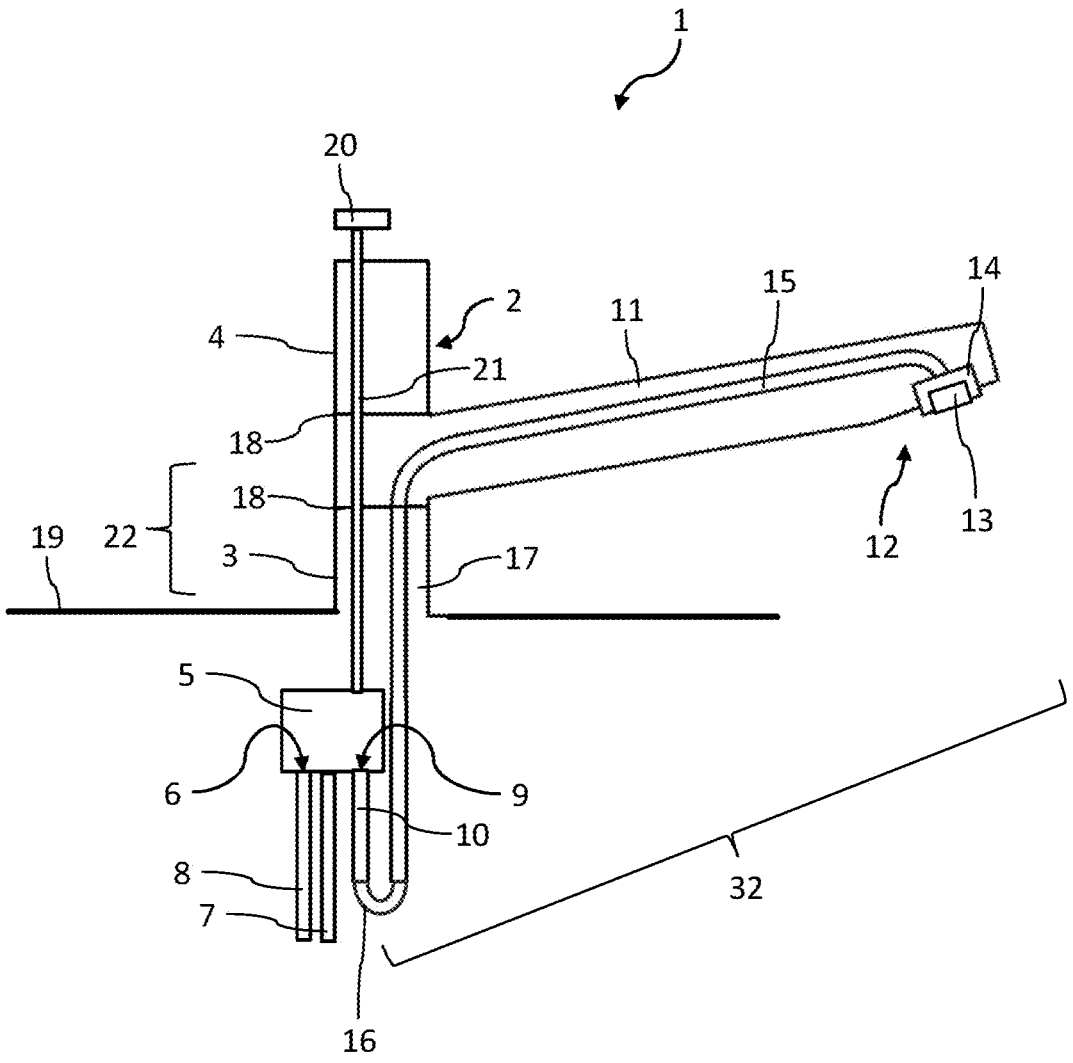
FIG. 3 shows a sanitary fitting having a valve lying outside the fitting housing.

FIG. 3 shows a further embodiment of a sanitary fitting 1 having a somewhat different construction than the sanitary fitting 1 of FIG. 1. Nevertheless, identical or functionally equivalent features are provided with the same reference signs. Only the features which differ in comparison to FIG. 1 are explained in more detail hereunder.

The outflow pipe 11 of the sanitary fitting 1 in this embodiment is designed in the same way as it is in the sanitary fitting 1 of FIG. 1. However, the valve 5 here is not disposed in the upper housing part 4 but completely outside the fitting housing 2, for example below a vanity 19, or in any case below a base point of the sanitary fitting 1.

An activation element 20 for the valve 5, which is connected to the valve by way of a control connection 21, is disposed on the upper housing part 4 of the sanitary fitting 1. The control connection 21 can be designed, for example, as a rod, flexible tube, Bowden cable or toggle link. The control connection 21 in the embodiment shown is routed within the duct 17. It is advantageous in this embodiment that the sanitary fitting 1 has practically no restrictions at all in terms of its shape because all water-directing elements are connected by hoses and fundamentally lie outside the sanitary fitting 1. The assembling of the hoses is also simplified in this embodiment, because they are freely accessible.

Figure 4:
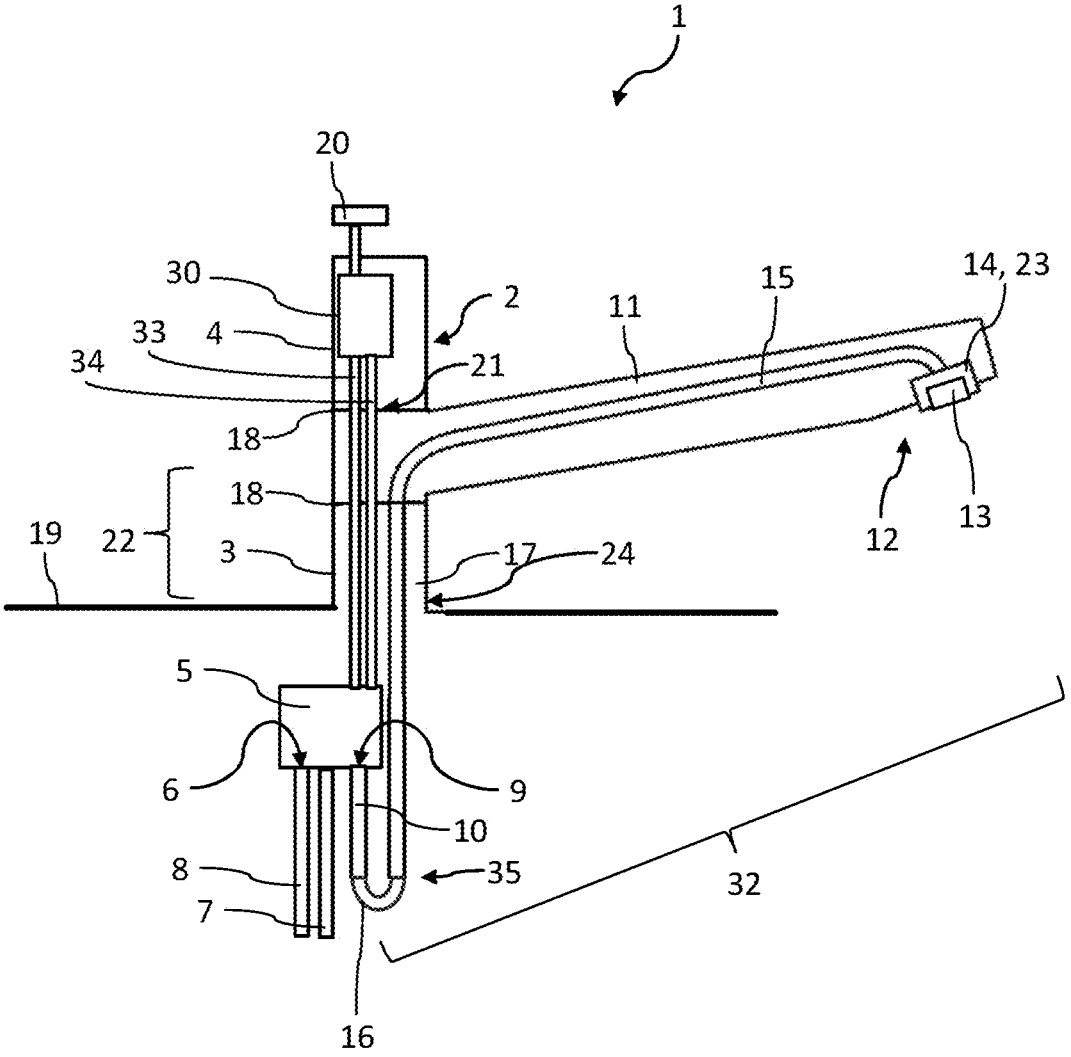
FIG. 4 shows a sanitary fitting according to the invention, similar to that in FIG. 3, having a fluidically acting control connection.

FIG. 4 shows a further exemplary embodiment. Components and functional modules which are functionally and/or structurally equivalent or identical to the preceding exemplary embodiments are denoted by the same reference signs and are not separately described again. The explanations pertaining to the preceding exemplary embodiments therefore apply in an analogous manner to FIG. 4.

The exemplary embodiment according to FIG. 4 differs from that of FIG. 3 at least in that the control connection 21 is fluidic and establishes an operative connection between a pilot valve 30, which is mechanically activatable for example, and the valve 5 (as the main valve).

For this purpose, the control connection 21 has an infeed line 33 to the pilot valve 30, and a return line 34 from the pilot valve to the valve 5.

Figure 5:
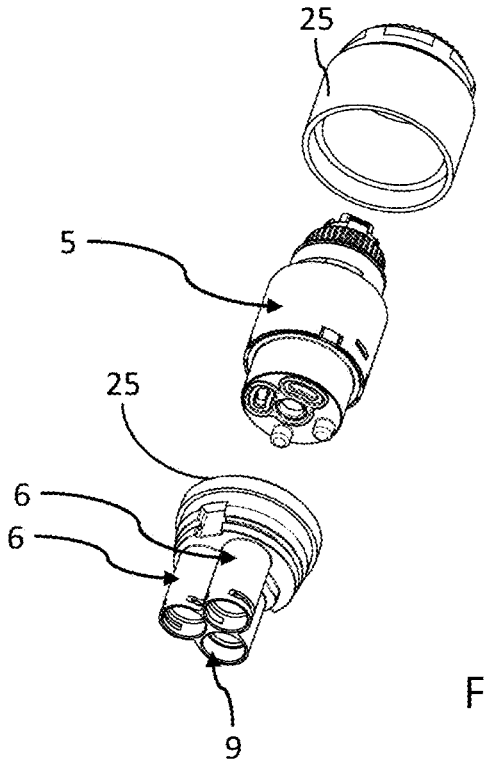
FIG. 5 shows an exploded illustration of a valve of a sanitary fitting having a pressure housing.

FIG. 5 shows a more detailed illustration of the valve 5. Components and functional modules which are functionally and/or structurally equivalent or identical to the preceding exemplary embodiments are denoted by the same reference signs and are not separately described again. The explanations pertaining to the preceding exemplary embodiments therefore apply in an analogous manner to FIG. 5.

The infeed connectors 6 and the outflow connector 9 are disposed in a pressure housing 24 which here by way of example is in two parts. The pressure housing 24 encloses the valve 5 and establishes a fluidic connection. The pressure housing 24 can in particular absorb an operating pressure of the infeed connectors 6 in such a way that the valve 5 can be disposed outside a sanitary fitting 1.

Figure 6:
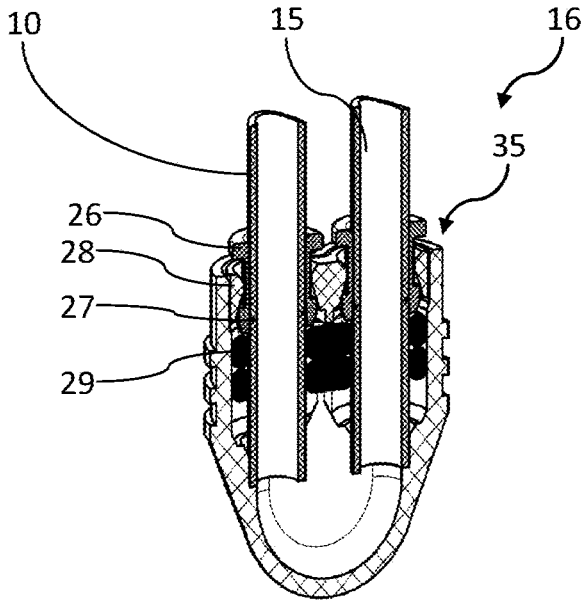
FIG. 6 shows a sectional view of a deflection of a fluidic assembly.

FIG. 6 shows a more detailed illustration of the deflection 16. Components and functional modules which are functionally and/or structurally equivalent or identical to the preceding exemplary embodiments are denoted by the same reference signs and are not separately described again. The explanations pertaining to the preceding exemplary embodiments therefore apply in an analogous manner to FIG. 6.

The deflection 16 has two claw supports 26 which have claws 27 by way of which one hose, here by way of example the mixed water hose 10 and the outflow hose 15, can in each case be held so as to be secured against tension. The claw supports 26 herein are disposed in holding-down devices 28 so as to be rotatable but self-securing. Torsion in the hoses can be easily compensated for by a relative rotation of the claw supports 26 in relation to the holding-down devices 28.

LIST OF REFERENCE SIGNS

1 Sanitary fitting
2 Fitting housing
3 Lower housing part
4 Upper housing part
5 Valve
6 Inflow connectors
7 Cold water hose
8 Hot water hose
9 Outflow connector
10 Mixed water hose
11 Outflow pipe
12 Free end of the outflow pipe
13 Outflow piece
14 Outflow piece receptacle
15 Outflow hose
16 Deflection
17 Duct
18 Pivoting location
19 Fitting support
20 Activation element
21 Control connection
22 Portion
23 Outflow piece connector
24 Base point
25 Pressure housing
26 Claw support
27 Claw
28 Holding-down device
29 Seal
30 Pilot valve
31 Connecting element
32 Fluidic assembly
33 Infeed line
34 Return line
35 Valve-proximal end

The invention claimed is:

1. A fluidic assembly (32), comprising:
a valve (5);
an outflow piece (13) which is connectable in an outflow pipe (11) of a fitting housing (2);
an outflow hose (15) which fluidically connects the outflow piece (13) to the valve (5);
an outflow piece receptacle (14) fastened to the fitting housing (2); and
a fixed deflection (16) which connects the outflow hose (15) and a mixed water hose (10) of the valve (5).

2. The fluidic assembly (32) as claimed in claim 1, wherein the outflow piece receptacle (14) is an outflow piece connector (23) which is formed on the outflow hose (15), and wherein the outflow piece (13) is releasably connected to the outflow piece connector (23).

3. A fitting, comprising:
the fluidic assembly of claim 1; and
a fitting housing (2),
wherein the outflow pipe (11) is formed on the fitting housing (2) and the outflow hose (15) is disposed in the fitting housing; and
wherein the outflow piece (13) is connected to the outflow pipe (11).

4. The fitting as claimed in claim 3, wherein the outflow pipe (11) is pivotable relative to the fitting housing (2), the outflow hose (15) has, at a location spaced apart from both ends thereof, the fixed deflection (16), the fitting housing (2) has a duct (17) in which the outflow hose (15) is routed and in which at least one portion (22) of the outflow hose (15) that runs in the duct (17) is rotatable about an axis that runs along a pivot axis of the outflow pipe (11), and the outflow hose (15) is fastened in at least one of the deflection (16) or an outflow piece connector (23) so as to be rotatable about a longitudinal axis of the outflow hose (15).

5. The fitting (1) as claimed in claim 4, wherein the duct (17) extends at least between the fixed deflection (16) and at least one of a water outflow or the valve (5).

6. The fitting (1) as claimed in claim 4, wherein the duct (17) extends separately from an infeed hose (7, 8) and the mixed water hose (10) of the valve (5).

7. The fitting (1) as claimed in claim 4, wherein a lateral internal dimension of the duct (17) is at least double a hose diameter of the outflow hose (5).

8. The fitting as claimed in claim 3, wherein the valve (5) is disposed below a base point (24) of the fitting, a control connection (21) is connected to the valve (5), the fitting housing (2) has a duct (17) in which the outflow hose (15) is routed between the valve (5) and the outflow piece (13), and the control connection (21) is routed in the duct (17).

9. The fitting (1) as claimed in claim 8, wherein the control connection (21) comprises a rod, flexible tube, Bowden cable or toggle link.

10. The fitting (1) as claimed in claim 3, further comprising a fastening element by which the valve (5) is fastened to at least one of the fitting housing (2) or a fitting support.

11. The fitting (1) as claimed in claim 3, wherein the outflow piece (13) has at least one of a polygonal or concave circumferential contour.

12. The fitting (1) as claimed in claim 3, wherein the outflow piece receptacle (14) is fastened to the fitting housing (2).

13. The fitting (1) as claimed in claim 12, wherein the outflow piece (13) comprises a jet regulator, wherein the outflow piece (13) has a non-circular circumferential external contour, wherein the outflow piece receptacle (14) has a non-circular circumferential internal contour that is adapted to the non-circular circumferential external contour of the outflow piece (13), and wherein the outflow piece receptacle (14) has a non-circular circumferential external contour that is adapted to the non-circular circumferential internal contour thereof.

14. The fitting (1) as claimed in claim 3, wherein the outflow piece (13) is fastenable in the outflow piece receptacle (14) by a snap-fit latching connection.

15. The fitting (1) as claimed in claim 3, further comprising a seal disposed between the outflow piece (13) and the outflow piece receptacle (14).

16. The fitting (1) as claimed in claim 3, wherein the outflow hose (15) is rotatably fastened in at least one of a deflection (16), the valve (5), or an outflow piece connector (23).

17. The fitting (1) as claimed in claim 3, wherein the fitting housing (2) is designed without a seal on at least one pivoting location (18) of the outflow pipe (11).

18. The fitting (1) as claimed in claim 3, further comprising the mixed water hose (10), the mixed water hose (10)

being fluidically connected at a location of the valve (5) that in a use position of the valve (5) faces away from the outflow piece (13).

19. The fitting (1) as claimed in claim 18, wherein the outflow hose (15) is fluidically connected to the mixed water hose (10) by a connecting element (31) that forms a deflection (16).

20. The fitting (1) as claimed in claim 19, wherein the deflection (16) establishes a fluidic change of direction between the mixed water hose (10) and the outflow hose (15).

21. The fitting (1) as claimed in one claim 3, wherein the outflow hose (15), between the outflow piece (13) and a valve-proximal end (35) of the outflow hose (15), extends in a portion outside the fitting housing (2).

22. A sanitary fitting comprising the fluidic assembly (32) as claimed in claim 1, and the fitting housing (2), wherein the outflow pipe (11) is pivotably mounted.

23. A fluidic assembly, comprising: a hose, an outflow piece (13), an outflow piece connector (23), a valve (5) for forming a sanitary fitting (1), and a fixed deflection (16) which connects the hose and a mixed water hose (10) of the valve (5).

* * * * *